United States Patent [19]

Wright et al.

[11] Patent Number: 4,509,717

[45] Date of Patent: Apr. 9, 1985

[54] SLIDE GATE VALVE FOR DRY BULK DISCHARGING CONTAINERS

[75] Inventors: Dennis C. Wright, Conneaut; Ernest J. Camodeca, Ashtabula, both of Ohio

[73] Assignee: Elkem Metals Company, Pittsburgh, Pa.

[21] Appl. No.: 475,273

[22] Filed: Mar. 14, 1983

[51] Int. Cl.[3] ..... F16K 51/00

[52] U.S. Cl. ..... 251/144; 251/159; 251/167; 251/176

[58] Field of Search ..... 251/144, 158, 159, 167, 251/176

[56] References Cited

U.S. PATENT DOCUMENTS

| | | | |
|---|---|---|---|
| 1,667,690 | 4/1928 | Hamm | 251/176 X |
| 1,727,677 | 9/1929 | Siebert | 251/159 X |
| 2,701,666 | 2/1955 | Hicks | 251/159 X |
| 3,237,915 | 3/1966 | Palmer | 251/158 |
| 3,661,357 | 5/1972 | Armstrong | 251/176 X |

FOREIGN PATENT DOCUMENTS

| | | | |
|---|---|---|---|
| 551569 | 10/1956 | Belgium | 251/144 |

*Primary Examiner*—Harold W. Weakley

*Attorney, Agent, or Firm*—Lucas & Just

[57] ABSTRACT

A slide gate valve assembly is provided wherein resilient means exert positive pressure to force a solid slide gate against the periphery of an aperture to establish a tight seal for retaining dry bulk particulate material in a container. Cam means are provided in the assembly to release the positive pressure on the side gate which may thereupon be removed from the aperture to dump the contents from the container.

6 Claims, 10 Drawing Figures

SLIDE GATE VALVE FOR DRY BULK DISCHARGING CONTAINERS

This invention relates to a slide gate valve for use in dry bulk discharging containers such as calcium carbide containers in which up to five or more tons of the product may be transported.

Slide gate valves for calcium carbide containers have been previously suggested but in the prior art structures, the slide gate was mechanically forced against a sealing gasket as by cams. Damage to the cams, container distortion or vibration during transportation handling had a tendency to break the seal. When leaking calcium carbide comes into contact with water, acetylene gas is generated to create an explosive atmosphere and the danger of fire.

This drawback has now been overcome and in accordance with the present invention a tight seal is achieved by resilient means which maintain a positive pressure on the slide gate to force it against the sealing gasket. The resilient means compensate for vibration and container distortion and are adapted to maintain sealing pressure even though the actuating cams used to release sealing pressure on the slide gate may be damaged.

This invention may best be understood by reference to the drawings which disclose a preferred embodiment and in which.

Figure 8:
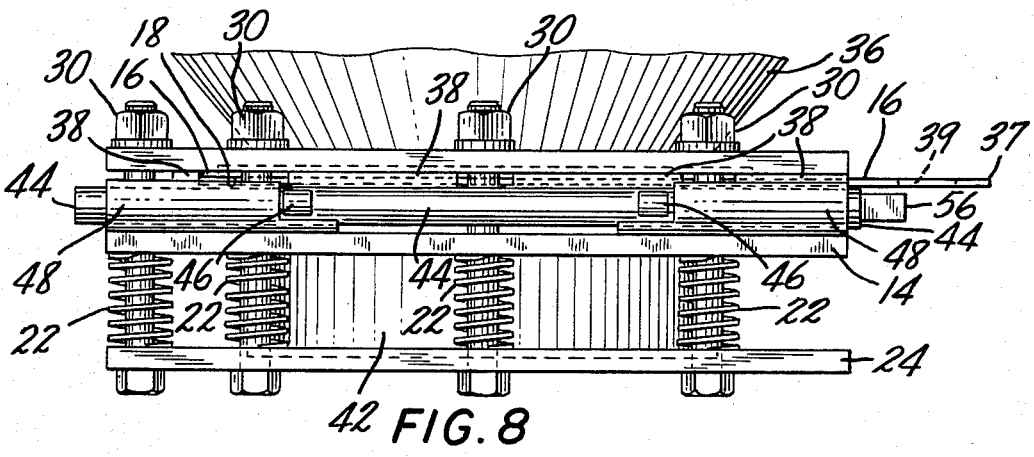
Figure 9:
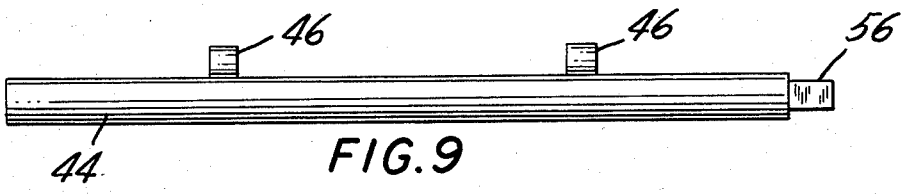
Figure 10:
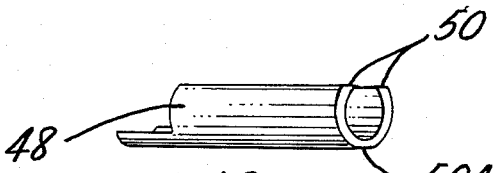

FIG. 8 is a side view of one preferred form of cam means for releasing the slide gate 16 from the assembly to dump the contents of container 36; and FIGS. 9 and 10 illustrate the details of the one preferred form of the cam means of FIG. 8.

Figure 1:
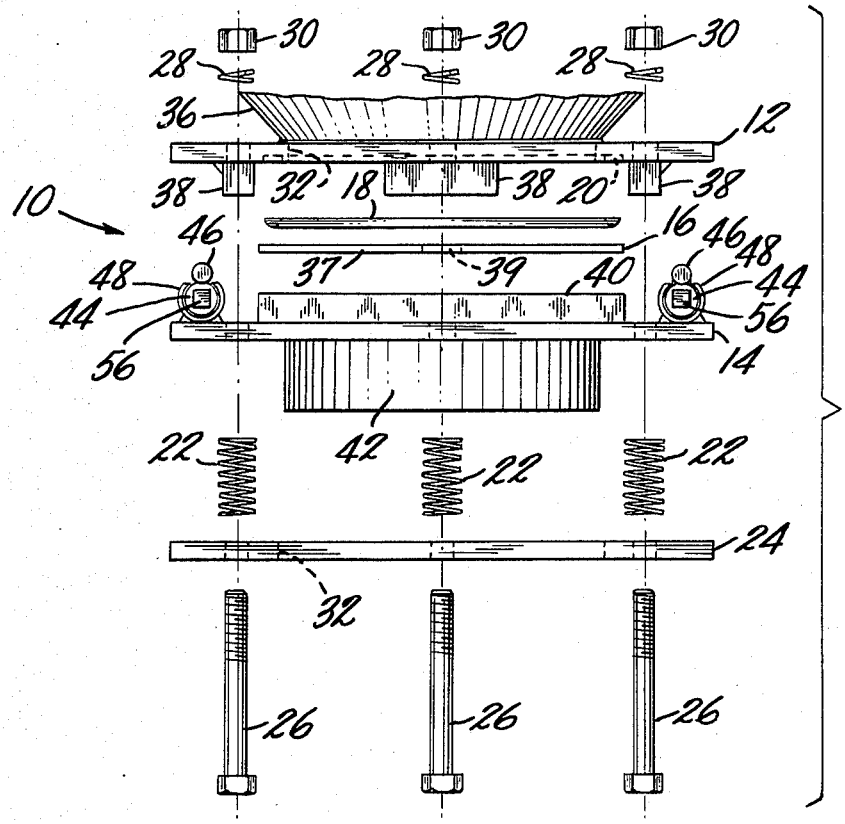
FIG. 1 is an expanded view of one preferred form of structure.
Figure 2:
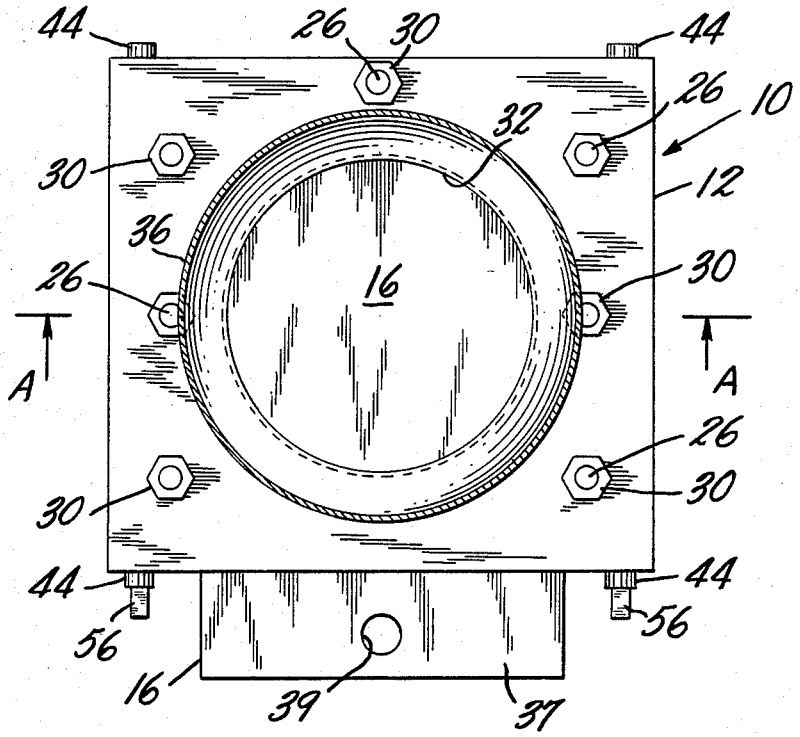
FIG. 2 is a top view of the assembled components of FIG. 1.
Figure 3:
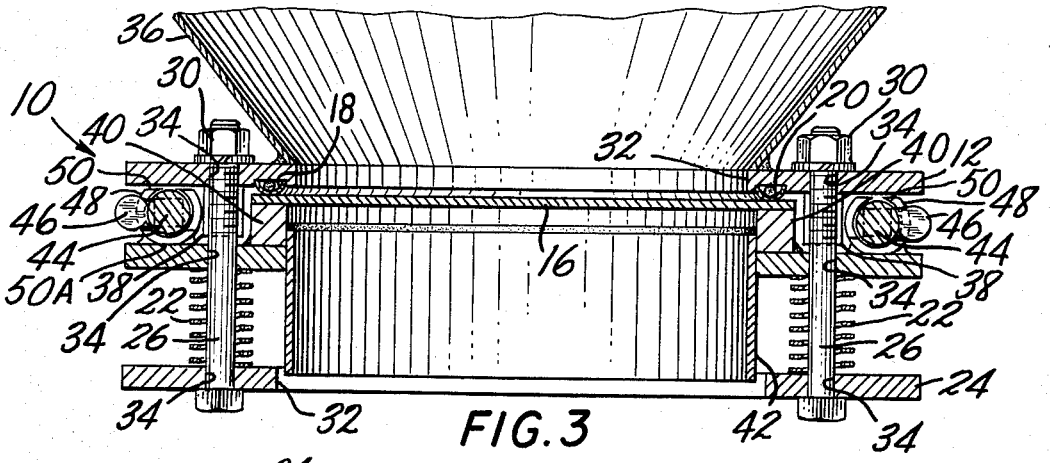
FIG. 3 is a cross-section taken on line A—A of FIG. 2.

Turning now to FIG. 1, the preferred form of slide gate valve 10 comprises a first top clamping plate 12 and a second bottom clamping plate 14 which in the assembled valve of FIG. 3 applies positive pressure against the slide gate valve member 16 forcing it into a tight sealing relationship with a conventional gasket 18 mounted in any convenient manner such as by an annular channel 20 in the first clamping plate to surround the periphery of a discharge aperture 32. The positive pressure urging the clamping plates together is generated by resilient means which in the preferred form of structure comprises seven spaced coil springs 22 that are biased against the second clamping plate 14 by means of a third bottom plate 24 and spaced bolts 26 which are drawn up tight to assemble the components (FIG. 3) and compress coil springs 22 to the extent required to obtain a tight seal between slide gate 16 and gasket 18. In the preferred structure the assembly bolts 26 are inserted through the coil spring opening and secured in the assembly by means of lock washers 28 and nuts 30. In the preferred form of structure illustrated it will be noted that all three of the plates 12, 14 and 24 are free to slide along the length of bolts 26 but it is obvious that plates 12 and 24 may be stationary; it being only necessary for plate 14 to slide on the bolts.

Figure 4:
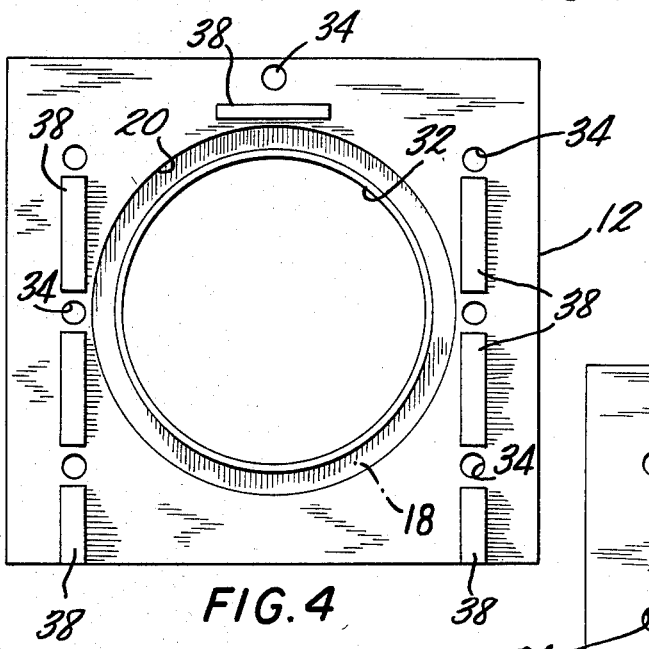
FIG. 4 is a bottom plan view of the first clamping plate 12 of FIG. 1.
Figure 5:
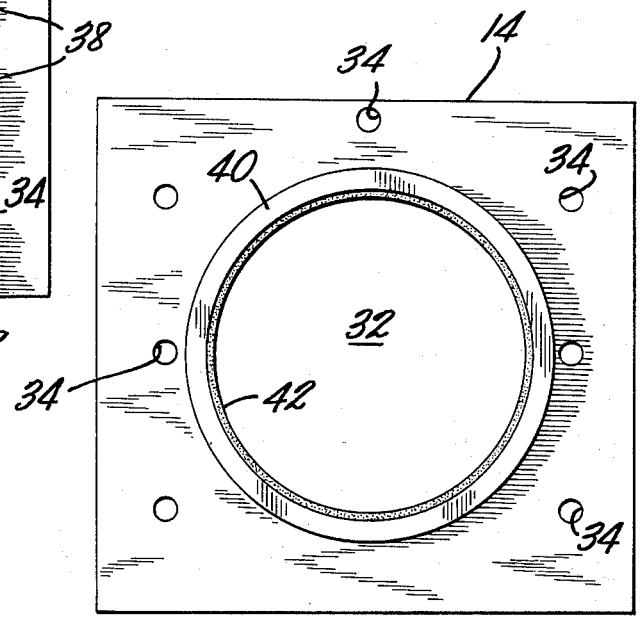
FIG. 5 is a plan view of the top of the second clamping plate 14 of FIG. 1.
Figure 6:
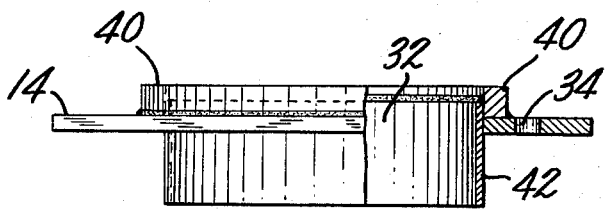
FIG. 6 is an end view of the second clamping plate 14 of FIG. 5 one end of which is in cross-section to better illustrate details of the structure.

Details of one preferred form of the clamping plates 12 and 14 are shown in FIGS. 4 and 5 and 6 respectively. As shown in FIGS. 4, 5 and 6 the clamping plates 12 and 14 are provided with a center annular aperture 32 and assembly bolt holes 34 all positioned to be aligned in the assembled structure shown in FIG. 3. The third bottom plate 24 also has a central annular aperture 32 and bolt holes 34 (FIG. 3) that align with the apertures and bolt holes of the first and second clamping plates in the assembled structure of FIG. 3.

The first top clamping plate is welded to the bottom of a suitable container 36 with the aperture 32 aligned with a mating annular aperture 32 in the bottom of the container. The top clamping plate 12 may be welded to container 36 and the components of the slide valve 10 thereafter assembled thereon or the assembled slide valve 10 may be welded to the container whichever procedure is most convenient.

Figure 7:
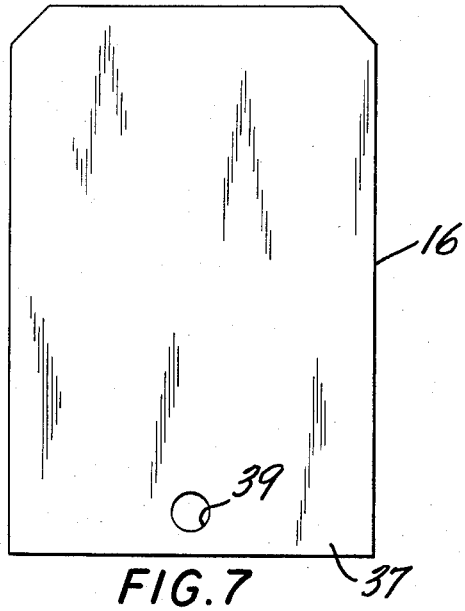
FIG. 7 is a plan view of the solid sliding gate used to seal aperture 32 and to open the aperture to discharge the contents from container 36.

The first clamping plate 12 is provided with a plurality of spaced flanges 38 which provide a convenient guide for sliding the solid slide gate plate 16 (FIG. 7) into position to establish a tight seal with gasket 20 and for withdrawing the slide gate to open aperture 32 to dump the contents from container 36. The slide gate 16 is made long enough so that one end portion 37 projects out from the valve assembly and the slide gate has an aperture 39 for ease of manipulation.

The second clamping plate 14 is provided with an annular flange 40 which as best shown in FIG. 3 bears against the slide gate 16 adjacent the periphery of aperture 32 in order to press the slide gate against gasket 18 and establish a tight seal with the gasket. Clamping plate 14 is also provided with an annular flange 42 that projects down around the periphery of aperture 32 to serve as a guide for discharging the contents of container 36 through aperture 32 in the third bottom plate 24.

A convenient form of cam means are provided to compress the coil springs 22 in order to release the positive pressure of the coil springs so that the solid slide gate 16 may be readily removed from the assembly to clear aperture 32 for dumping the contents of container 36. One preferred form of cam means is shown in detail in FIGS. 8, 9 and 10. As there shown, a cylindrical cam rod 44 is provided with a plurality of spaced round cam members 46 that are welded to the cam rod which is rotatively mounted in two spaced cylindrical sleeve members 48. The top and bottom portion of the sleeve members 48 are flattened at 50+50A to seat securely on the bottom of the first clamping plate 14 (FIG. 1) and to provide closing clearance between clamping plate 12 and plate 14. Two cam rods 44, each of which are rotatively mounted in spaced sleeve members 48, are positioned on opposite side portions of the second clamping plate 14 by welding the spaced sleeve members to the plate as illustrated in FIG. 3. The cam rods 44 are retained to rotate in the spaced sleeve members 48 by cams 46 that bear against the sleeve members 48. The cam rod may be provided with a squared end portion 56 adapted to fit a 'T' wrench which may be used for rotating the cam rods in opposite directions to bring cams 46 into contact with the first clamping plate 12 and cam down clamping plate 14 to compress springs 22 and release the positive pressure on the solid slide gate plate 16 so that it may be pulled out of the assembly to open aperture 32 and dump the contents of container 36. After the contents are dumped the slide gate is replaced and cam rods 44 are again rotated in opposite directions into the position shown in FIG. 3 to seal slide gate 16 against the gasket 18 whereupon the container is ready to be refilled.

It will be understood that one preferred structure has been chosen for the purpose of illustration. It will be obvious to those of skill in the art that resilient means other than coil springs 22 may be employed for exerting positive pressure against slide gate 16 with equivalent results. It will also be obvious that it is not necessary to employ the support plates of the preferred structure since equivalent cam means may be mounted to release the positive pressure of the resilient means without using the convenient form of plate structure herein chosen for the purpose of illustration. Handles may be used for rotating the cam rods 44 in place of the squared end portion 56. Bushings could obviously be used in place of the sleeve mount for cam rods 44 and bearing could be provided in the adjacent cylindrical sleeve sections 48.

It will be understood that it is intended to cover all changes and modifications of the preferred form of invention herein chosen for the purpose of illustration which do not constitute a departure from the spirit and scope of the invention.

What is claimed is:

1. A container for transporting dry materials in bulk having a discharge aperture in the bottom thereof and a valve assembly for opening and closing said discharge aperture comprising:

(a) a first plate member that extends out beyond the exterior wall of the periphery of said discharge aperture in the bottom of said container and has an aperture therein aligned with said discharge aperture, (b) a second plate member that extends out beyond the exterior wall of the periphery of said discharge aperture in the bottom of said container and has an aperture therein aligned with said aperture in the first plate member, (c) a third plate member that extends out beyond the exterior wall of the periphery of said discharge aperture in the bottom of said container and has an aperture therein aligned with said aperture in said second plate member, (d) one side of said first plate member being fixed to the bottom of said container, (e) means carried by said first plate member in position outside the exterior wall of the periphery of said discharge aperture in the bottom of said container for supporting the second and the third plate members with the apertures therein aligned with the aperture in said first plate member, (f) a solid gate valve member slidably mounted between said first and second plate members, (g) resilient means between said second and third plate members positioned outside the exterior wall of the periphery of said discharge aperture in the bottom of said container for exerting positive pressure against said second plate member to move it against said solid gate valve member and force it into a resilient sealing relationship with said first plate to close said discharge aperture, and (h) cam means in position outside the exterior wall of the periphery of said discharge aperture in the bottom of said container for releasing the positive pressure of said resilient means whereby said solid gate valve member may be slidably removed to open said discharge aperture.

2. The structure of claim 1 in which sealing gasket means is mounted on the second side of said first plate member to surround the outer periphery of said discharge aperture.

3. The structure of claim 1 in which the means carried by said first plate member for supporting and aligning said second and third plate members comprise a plurality of bolt members each of which are positioned in apertures in said first, second and third plate members located outside the periphery of the exterior wall of said discharge aperture.

4. The structure specified in claim 3 in which the resilient means comprise coil spring members which surround said supporting and aligning bolt members.

5. The structure of claim 1 in which the said cam means comprise at least two cam rods, means for rotatively mounting said cam rods on said second plate member outside the periphery of the exterior wall of said discharge aperture in the bottom of said containers and on opposite sides thereof, each of said cam rods having a plurality of cam members in position to be rotated against said first plate member to move said second plate member against the resilient means to compress said resilient means and release the pressure on said slide gate valve member whereby it may be slidably removed to open said discharge aperture.

6. The structure of claim 1 in which an upright annular flange is mounted on the surface of said second plate to surround the aperture therein in position to apply positive sealing pressure against said solid gate valve member.

* * * * *